US005680751A

United States Patent [19]

Premi

[11] Patent Number: 5,680,751

[45] Date of Patent: Oct. 28, 1997

[54] PNEUMATIC THREAD OR YARN JOINING APPARATUS FOR INSTALLATION ON TEXTILE MACHINES, IN PARTICULAR ON AUTOMATIC BOBBIN WINDING MACHINES

[75] Inventor: Mauro Premi, Brescia, Italy

[73] Assignee: Mesdan S.p.A., Brescia, Italy

[21] Appl. No.: 619,207

[22] Filed: Mar. 21, 1996

[30] Foreign Application Priority Data

Mar. 21, 1995 [IT] Italy ..... MI95A0558

[51] Int. Cl.[6] ..... D01H 15/00

[52] U.S. Cl. ..... 57/22; 242/35.6 R

[58] Field of Search ..... 57/22, 23, 35.6 R

[56] References Cited

U.S. PATENT DOCUMENTS

| | | | |
|---|---|---|---|
| 3,751,981 | 8/1973 | Jernigan et al. | 73/160 |
| 3,886,642 | 6/1975 | Neale, Sr. | 29/203 |
| 4,094,723 | 6/1978 | Jones | 156/353 |
| 4,437,298 | 3/1984 | Truzzi et al. | 57/22 |
| 4,481,761 | 11/1984 | Kimura | 57/22 |
| 4,570,500 | 2/1986 | Richter | 74/54 |
| 4,574,573 | 3/1986 | Guzzoni | 57/22 |
| 4,608,815 | 9/1986 | Rohner et al. | 57/22 |
| 4,610,132 | 9/1986 | Rohner et al. | 57/22 |
| 4,738,093 | 4/1988 | Zumfeld et al. | 57/22 |
| 4,765,128 | 8/1988 | Rosen et al. | 57/22 |
| 4,877,194 | 10/1989 | Matsui et al. | 242/35.6 R |
| 4,900,008 | 2/1990 | Fichter | 271/277 |
| 4,911,372 | 3/1990 | Uchida et al. | 57/22 |
| 4,938,013 | 7/1990 | Zumfeld | 57/22 |
| 4,939,893 | 7/1990 | Fujiwara | 57/22 |
| 4,988,050 | 1/1991 | Tone | 242/35.6 R |
| 5,155,987 | 10/1992 | Vogel | 57/22 |
| B1 4,411,128 | 10/1983 | Mima | 57/22 |

FOREIGN PATENT DOCUMENTS 34 37 026 4/1985 Germany .

*Primary Examiner*—Daniel P. Stodola
*Assistant Examiner*—Tina R. Taylor
*Attorney, Agent, or Firm*—Cushman Darby & Cushman Intellectual Property Group Pillsbury Madison & Sutro LLP

[57] ABSTRACT

A pneumatic thread or yarn knotless joining apparatus for installation on the winding positions of an automatic bobbin winding machine is provided with its own reversible electric stepping motor to cause stepwise rotation of the group of controlling drum cams firstly in an outward direction starting from a starting position and then in the return direction for controlling the synchronized movements of the various movable members. This cam group includes a cam of progressively increasing contour, preferably of stepped shape, for controlling the movement of the levers which withdraw the pretreated thread or yarn ends from the preparation members in the direction of the splicing chamber so as to be able to regulate, by choice of the number of advancement steps set, and hence the point reached on the contour of the cam, the extent of movement of the withdrawal levers from their rest position and hence the desired length by which the thread or yarn ends are superposed upon feeding into the splicing chamber the compressed air jet for making the knotless joint.

3 Claims, 7 Drawing Sheets

PNEUMATIC THREAD OR YARN JOINING APPARATUS FOR INSTALLATION ON TEXTILE MACHINES, IN PARTICULAR ON AUTOMATIC BOBBIN WINDING MACHINES

BACKGROUND OF THE INVENTION

This invention relates to a pneumatic thread or yarn joining apparatus for installation on textile machines, in particular on bobbin winding machines.

Textile machines such as winding machines and in particular automatic bobbin winding machines of modern design are known to be provided with numerous working positions (for example 32, 60 etc.), in many of such machines there being installed on each working position a thread or yarn joining apparatus for restoring continuity to the operating thread or yarn should it undergo interruption caused either by the necessary elimination of defective portions or by accidental breakage or by the depletion of the package from which the thread or yarn is unwound. In the past such joining apparatus generally consisted of mechanical knotters, but apparatus for pneumatically joining the thread or yarn without knotting have been increasingly used for some time. These latter apparatus, commonly known as splicers, comprise a splicing chamber into which the threads or yarns to be joined together are inserted through a longitudinal slot and into which a compressed air jet is fed to pneumatically form the joint without knotting. Splicers of this type are widely known in the art and are described for example in DE 34 37 026, U.S. Pat. No. 4,411,128 and many others.

A typical example of a known apparatus (or splicer) for joining threads or yarns using compressed air comprises substantially a splicing chamber with a longitudinal slot for inserting the threads or yarns to be joined, a cover for temporarily closing the longitudinal slot in the splicing chamber, members for preparing the thread or yarn ends to be joined together and positioned spaced from the opposing lateral openings in the splicing chamber, means for feeding compressed air jets into the preparation member and into the splicing chamber, means external to the splicing chamber for clamping the threads or yarns inserted into it, means for cutting the thread or yarn ends emerging from the opposing lateral openings in the splicing chamber, levers for withdrawing the thread or yarn ends from the preparation members in the direction of the splicing chamber to superpose said ends by a determined length on feeding the compressed air jet into the splicing chamber, and a group of drum cams for achieving the synchronized movement of the various movable members of the apparatus. To execute a complete joining cycle the shaft of the drum cams is connected to a drive shaft to rotate the drum cams through a complete revolution of 360°.

An example of a cycle for pneumatically joining threads or yarns without knotting using a compressed air apparatus of the aforesaid type, the cycle also comprising pneumatically pretreating the thread or yarn ends to be joined to untwist the fibres and make them parallel, comprises the following steps in succession, controlled by the drum cams: inserting the two threads or yarns to be joined, into the splicing chamber through its longitudinal slot, with the two threads or yarns originating from opposite directions, so that the free thread or yarn ends emerge through the two opposing lateral openings in the splicing chamber; closing the longitudinal slot of the splicing chamber by means of the cover; clamping externally to the splicing chamber the two threads or yarns entering it; cutting the thread or yarn ends emerging from the opposing lateral openings in the splicing chamber at a determined distance from this latter; inserting the cut thread or yarn ends into the preparation members for pneumatically pretreating these ends; feeding a compressed air jet into the preparation members for a predetermined time and/or at a predetermined pressure; withdrawing the preparation members from the prepared thread or yarn ends in the direction of the splicing chamber to achieve the predetermined length of superposing of the prepared thread or yarn ends; feeding a compressed air jet into the splicing chamber for a predetermined time to effect the actual pneumatic joining of the threads or yarns; reopening the cover and releasing the joined thread or yarn; and returning the various moving members of the splicer to their original position.

To optimize the result of the pneumatic knotless joining and obtain a solid strong joint of good appearance the splicer must be properly adjusted for the type of thread or yarn being worked, by setting the basic parameters of the joining cycle. In compressed air splicers these adjustments relate specifically to the following parameters:

a) duration and/or pressure of the compressed air jet fed into the preparation members for pretreating the thread or yarn ends to be joined together;

b) duration of the compressed air jet fed into the splicing chamber to execute the pneumatic knotless joining of the threads or yarns;

c) length by which the prepared thread or yarn ends are superposed on feeding the compressed air let into the splicing chamber.

As textile machines, and in particular automatic bobbin winding machines, can be used for working threads or yarns having very different characteristics in relation to count, twist, material etc., the adjustment of splicers installed on the machine working positions must be made each time the type of thread or yarn being worked on the machine or on part of it is changed, in order to ensure that an optimum pneumatic knotless joint is always achieved by the splicers installed on the machine working positions or on those of the machine section in which the thread or yarn being worked has been changed. Because of the large overall number of splicers installed on such machines, the adjustments, if made individually and manually for each splicer, involve a considerable cost and require considerable time, because of which the machine operators quite often dispense with the necessary adjustments, to the detriment and prejudice of the quality of the thread joint obtained by the splicer.

The availability of a centralized control system for overall splicer adjustment located in a single remote position, for example in the headstock or on board the machine, would therefore be advantageous in reducing the time required and in eliminating machine downtimes.

The centralization of the control system for regulating the duration and/or pressure of the compressed air jet to be fed into the preparation members for the thread or yarn ends to be joined together, and the duration of the compressed air jet to be fed into the splicing chamber for executing the actual pneumatic knotless joint, is fairly simple and has already been proposed, using solenoid valves remotely controllable individually to determine the moment and duration of the respective compressed air jets. In this case, instead of being operated by relative control cams, the valves for feeding compressed air into the preparation members and into the splicing chamber are replaced by solenoid valves operated remotely for the required opening time. More complicated and not yet implemented is the centralized control system for regulating and remotely determining the required length by which the prepared thread or yarn ends are superposed on feeding the compressed air jet into the splicing chamber. In this respect, in traditional splicers this superposed thread or yarn end length is determined by the extent of movement of the withdrawal levers from their rest position, this extent being normally established by adjustable mechanical stops positioned manually to limit the movement of the withdrawal levers from their rest position to a required valve. This manual variation in the arrangement of the mechanical stops for the withdrawal levers must therefore be done individually on each splicer installed in the working positions of the entire machine or on those of that machine section in which the working thread or yarn is to be changed. This adjustment hence requires a considerable time.

SUMMARY OF THE INVENTION

The object of the present invention is therefore mainly to provide an apparatus for knotless pneumatic thread or yarn joining to be installed on textile machines, in particular on automatic bobbin winding machines, in which the length by which the thread or yarn ends to be joined together are superposed upon feeding the compressed air jet into the splicing chamber, is remotely adjustable, hence avoiding the need to make this adjustment manually on the apparatus.

This object is attained according to the invention by an apparatus for pneumatic thread or yarn joining of the type defined heretofore, characterised by being provided with its own reversible electric stepping motor remotely operable by electrical pulses, to cause stepwise rotation of the group of controlling drum cams in an outward direction starting from a starting position and then, after a determined number of advancement steps, rotation in the return direction, and with a withdrawal lever movement control cam of progressively increasing contour, preferably of stepped shape, such that as the advancement steps in the outward direction increase starting from the starting position of the controlling drum cams, a progressively increasing movement of the withdrawal levers from their rest position is induced for each successive point on the contour of said cam, and further, if the valve for feeding the compressed air jet into the preparation members for the thread or yarn ends to be joined together is operated by one of the control cams of the group of drum cams, by providing this control cam with an active track and with an inactive bypass track, so as to cause the valve to open only by its active track during rotation of the group of drum cams in the outward direction and to prevent valve operation during rotation of the group of cams in the return direction.

By means of the expedients of the present invention it is possible to rotate the group of controlling drum cams of the joining apparatus stepwise both in the outward direction and in the return direction. Because of the progressively increasing contour of the cam controlling the movement of the withdrawal levers for the thread or yarn ends, for each successive point on this contour there is achieved, during rotation in the outward direction, a progressively increasing movement of the withdrawal levers from their rest position, corresponding to a precise extent of withdrawal of the thread or yarn ends from the preparation members in the direction of the splicing chamber and hence a properly determined length by which the pretreated thread or yarn ends are superposed on feeding the compressed air jet into the splicing chamber. It is hence necessary merely to halt the outward rotation of the controlling drum cams at the desired point (ie after a certain number of advancement steps) of the contour of the control cam which drives the withdrawal levers, to be certain of having achieved the required length by which the thread or yarn ends are superposed. If now, after this certain number of advancement steps in the outward direction, the direction of rotation of the electric stepping motor is reversed and this motor is made to execute an equal number of return steps, the controlling drum cams of the joining apparatus are made to rotate in the return direction, into their starting position. The withdrawal levers are not further shifted from their attained position of movement, whereas during the return rotation of the controlling drum cams these cause the relative controlled movable members of the joining apparatus to undergo movements which are the exact reverse of those effected during the rotation in the outward direction. Because of the provision of the bypass track on the cam controlling the valve through which the compressed air jet is fed into the members for preparing the thread or yarn ends, this track being provided only if this valve is operated by a cam of the group of drum cams, this valve is prevented from further operating during the return rotation of the group of drum cams, in that the introduction of a further compressed air jet into the preparation members at this stage could cause problems. It should, however, be noted that the valve for feeding the compressed air jet into the preparation members could consist of a remotely operable solenoid valve not requiring a control cam.

It should also be noted that for the valve for feeding the compressed air jet into the splicing chamber there is provided a separate remote control, i.e., not deriving from a drum cam of the group of controlling cams.

This can be achieved in known manner, by again using for this purpose a separate solenoid valve which has to be operated for feeding the compressed air jet into the splicing chamber at a moment immediately following the attaining of the desired movement of the withdrawal levers for the thread or yarn ends, i.e., immediately following the termination of outward rotation of the controlling drum cams.

Rotation of the group of controlling drum cams both in the outward direction and in the return direction is made possible by the fact that these cams, even if they are continuous and are rotated in a single direction, have a contour such that during a first angle of rotation they cause the relative controlled movable members to move in one direction, and during a following angle of rotation they cause the same controlled movable members to undergo movements which are the exact reverse. In other words, the contours of these cams are in practice always specularly symmetrical about a central point. This observation has enabled the expedient to be used of rotating the group of controlling drum cams firstly in an outward direction of rotation starting from a starting position and then in a return direction of rotation. In this manner, not only is it possible to interrupt the outward rotation at the moment of attaining the desired movement of the withdrawal levers from their rest position, hence preventing their further movement without the need to provide mechanical stops, but in addition a certain reduction in the duration of the joining cycle is achieved in that it is not necessary to rotate the controlling cams each time, at least until the maximum movement of the withdrawal levers from their rest position is achieved. The contour of the controlling drum cams is doubly utilized according to the invention, to cause the controlled members to move in one direction during outward rotation and to cause the same controlled members to undergo movements exactly in the reverse sense during return rotation.

BRIEF DESCRIPTION OF THE DRAWINGS

The present invention will be more apparent from the detailed description of one embodiment of a joining apparatus to be installed on a winding position of an automatic bobbin winding machine, given hereinafter with reference to the accompanying schematic drawings, in which.

DETAILED DESCRIPTION

Figure 1:
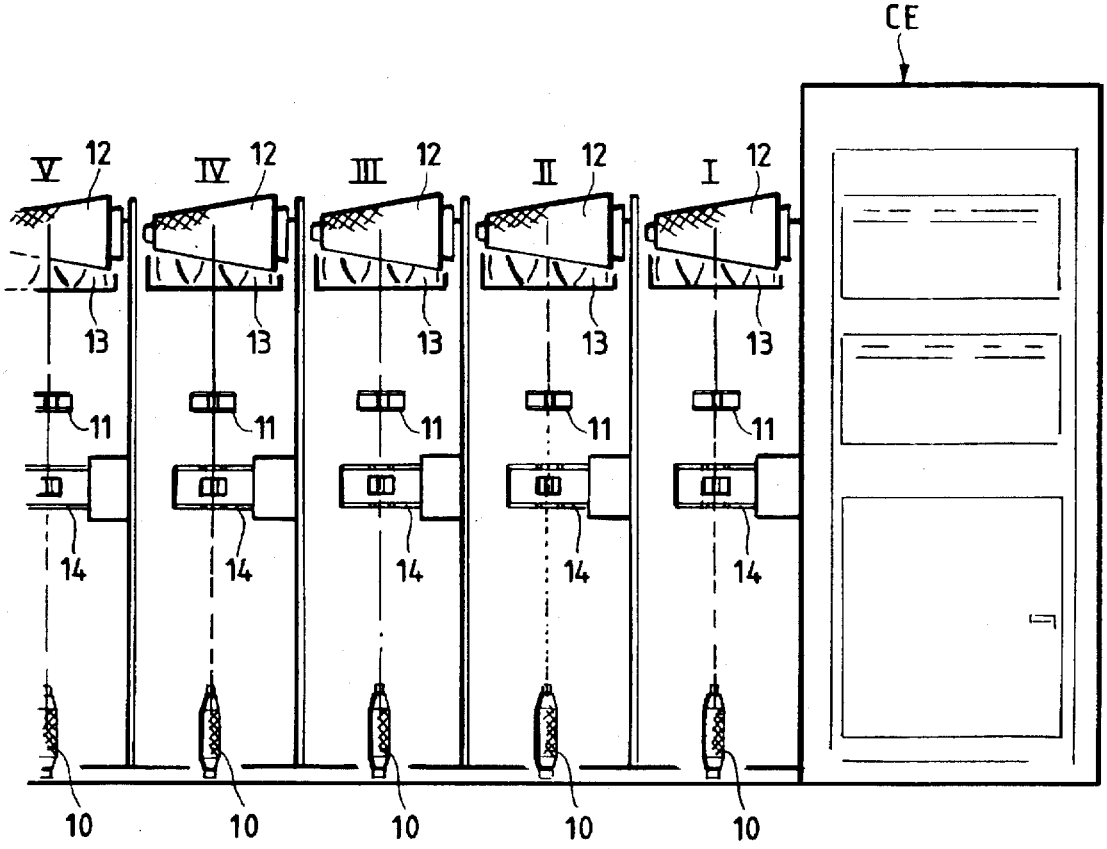
FIG. 1 is a front view of part of an automatic bobbin winding machine showing a number of winding positions.
Figure 2:
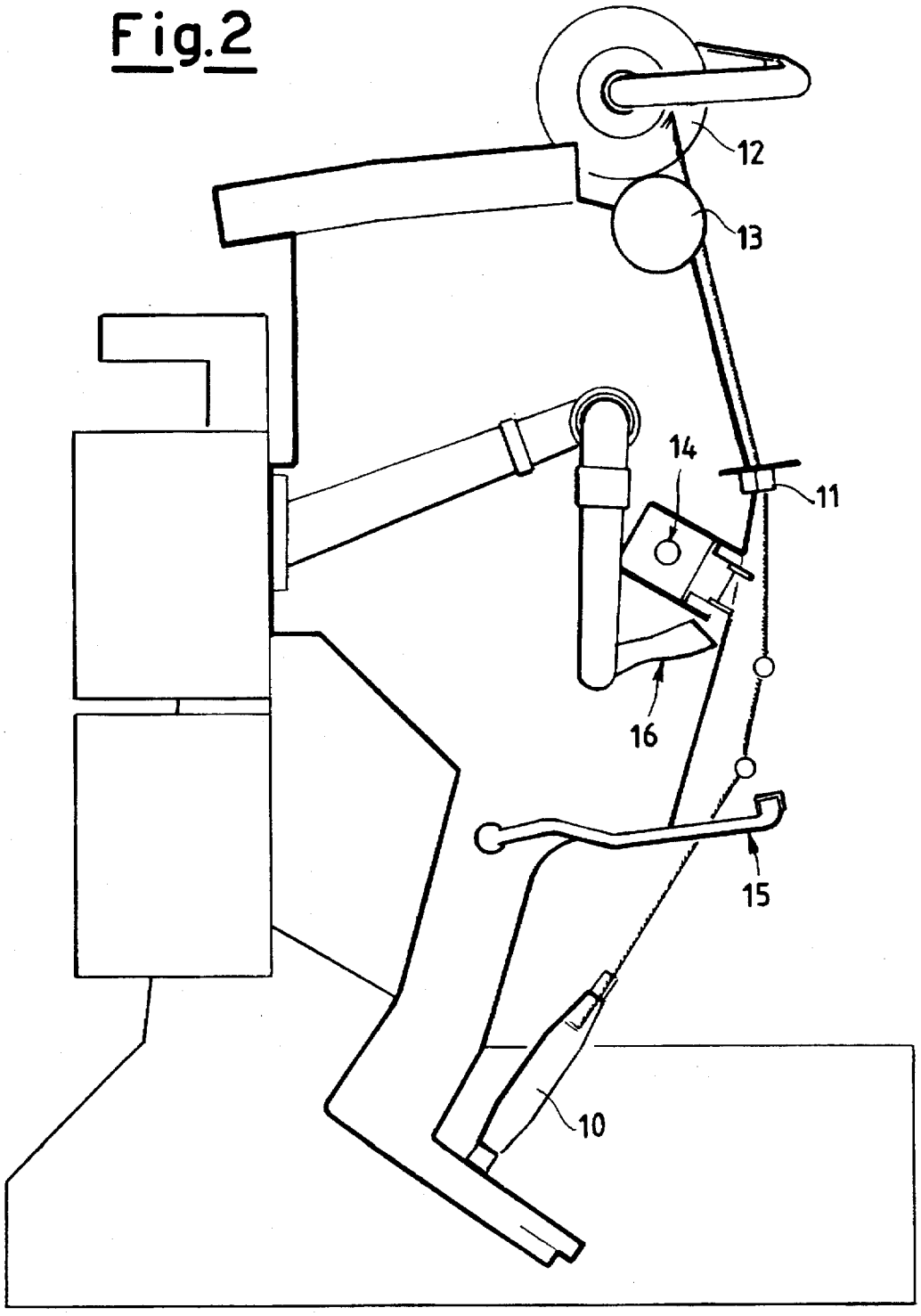
FIG. 2 is a side view of a winding position of the automatic bobbin winding machine of FIG. 1.
Figure 3:
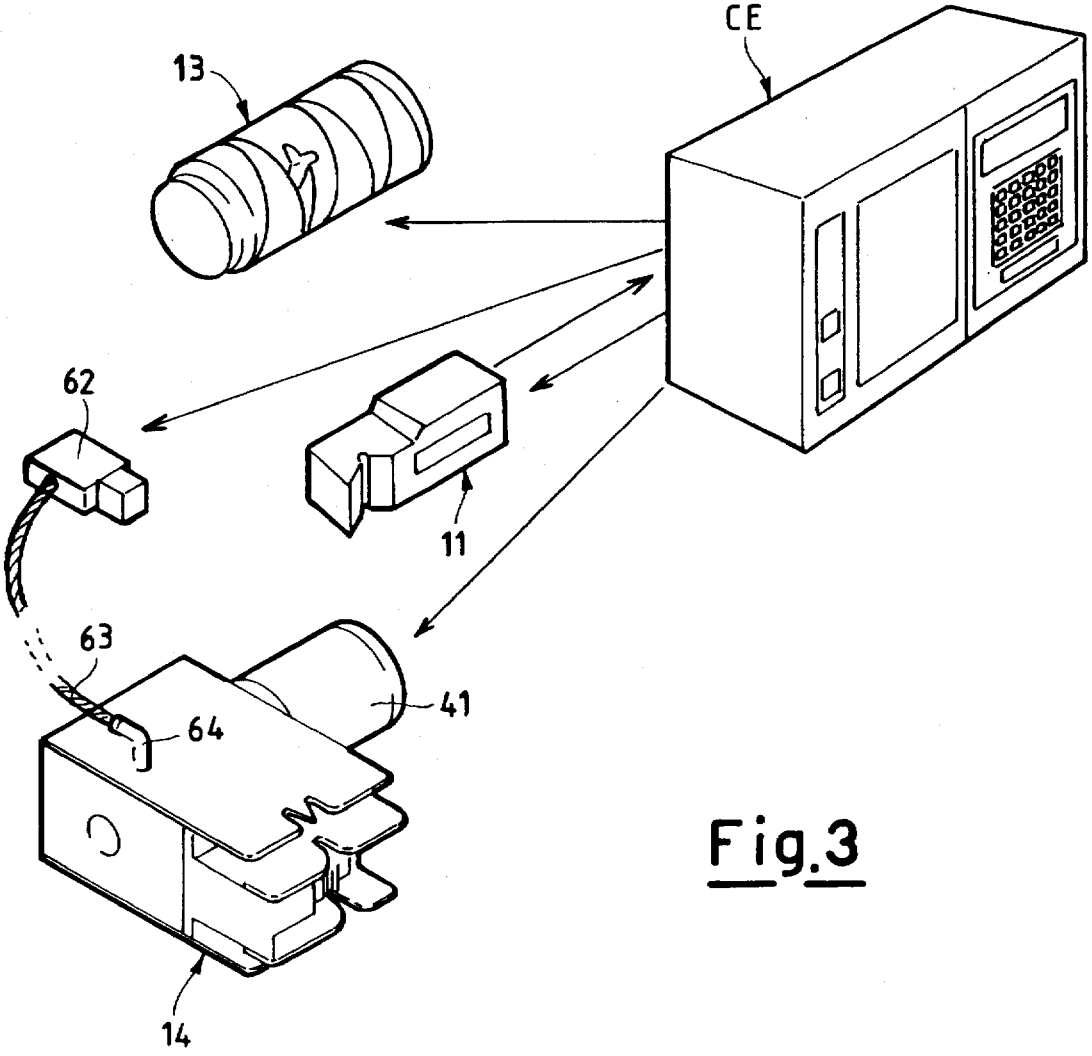
FIG. 3 is a scheme showing the commands fed by the central electronic control unit of the winding machine in the case of the required intervention of a joining apparatus in a winding position.
Figure 4:
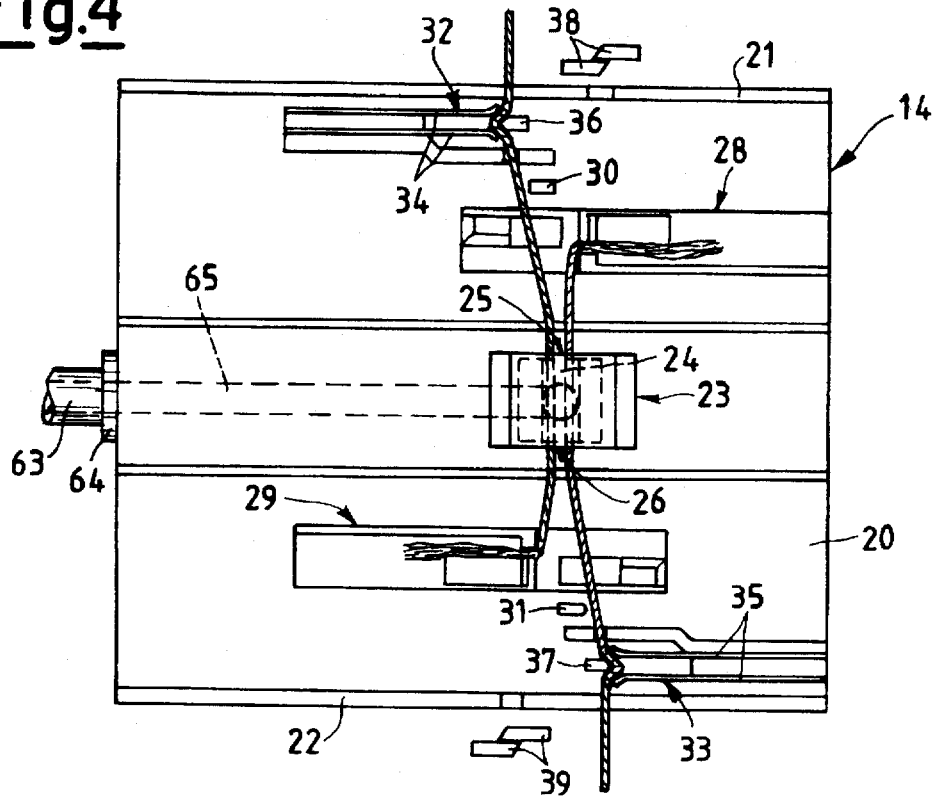
FIGS. 4 and 5 are schematic views from above of a joining apparatus according to the invention during different working stages, namely during the preparation of the thread or yarn ends and during the withdrawal of the prepared ends in the direction of the splicing chamber respectively.
Figure 5:
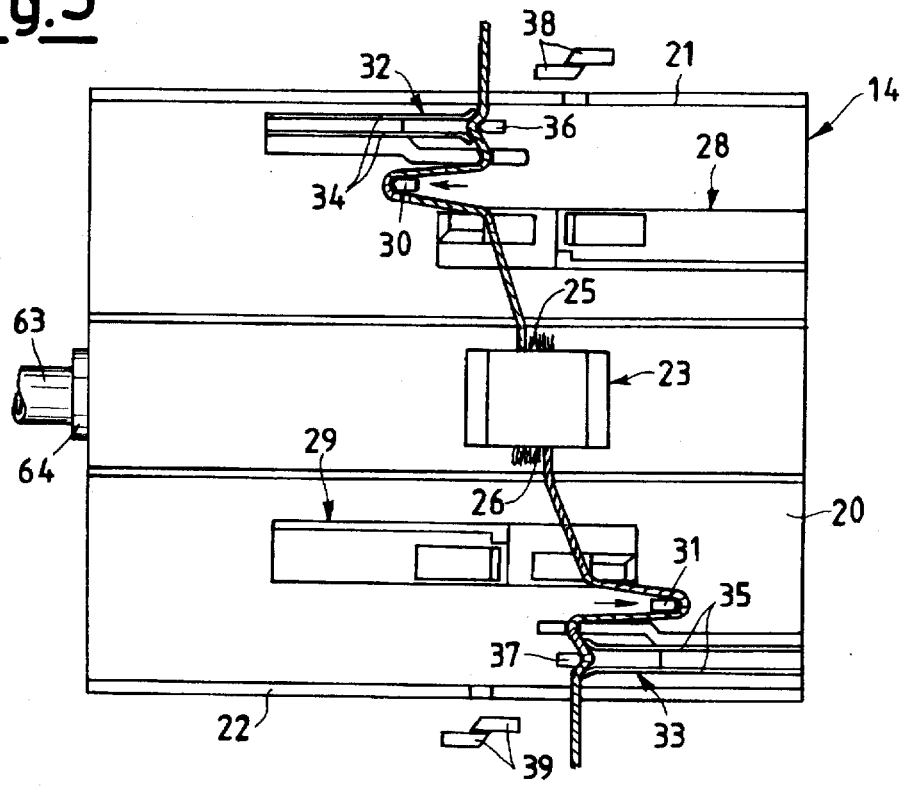

With reference firstly to FIGS. 1 to 3, these schematically illustrate part of an automatic bobbin winding machine of known type, showing a number of winding positions, indicated in FIG. 1 by I, II, III, IV and V. In the headstock of the machine, there is a central electronic controller of computer type, indicated by CE, from which all the various machine operating commands can be fed. Each winding position, of which in practice there are more than the five shown in FIG. 1, comprises substantially (see FIG. 2, in particular) a package 10 from which the thread or yarn to be rewound is unwound, a sensing device (yarn clearer) 11 for monitoring the continuity and condition (absence of irregularly thick or otherwise defective portions) of the yarn being unwound from the package 10, and the bobbin 12 on which the yarn is rewound and which is rotated by a roller 13. There is also installed in each winding position an apparatus, indicated overall by 14, for joining the yarn if interrupted (by accidental breakage or as a result of having eliminated a defective portion indicated by the device 11), or if the spool 10 has to be replaced by virtue of depletion.

With the joining apparatus 14 there are associated a rotatable suction arm 15 for locating the lower yarn from the package and a rotatable suction arm 16 for locating the upper yarn from the bobbin and for inserting the two yarns originating respectively from the package 10 and from the bobbin 12 into the joining apparatus 14 in order to rejoin these two yarns.

The machine components and their arrangement as described are all known in the art and do not require further detailed explanation. As can be seen from the control scheme of FIG. 3, if the device 11 indicates an irregularity and/or interruption of the operating yarn in one of the winding positions, the device (yarn clearer) 11 feeds a signal to the computer-operated electronic control centre CE, which then emits suitable signals, firstly for halting the roller 13 and then reversing its rotation for a determined time in order to unwind from the bobbin 12 the quantity of yarn necessary for it to be taken-up by the suction arm 16 and be brought into the joining apparatus 14. The suction arm 15 is rotated simultaneously to locate and take-up the yarn from the package 10 and insert it into the joining apparatus 14.

One of the pneumatic thread or yarn-joining apparatus 14 installed on the winding positions will now be described with reference to FIGS. 4 to 8. The apparatus 14 consists of a hollow structure 20, two opposite sides of which are closed by walls 21 and 22 respectively (these walls with the members carried by them being removed in FIGS. 6 and 7). On the top of the structure 20 there is fixed a head 23 containing the splicing chamber 24 open at its two opposing ends via lateral openings 25, 26 and provided upperly with a longitudinal slot for the insertion of the two threads or yarns to be joined together. A movable cover 27 is arranged to temporarily close the longitudinal slot in the splicing chamber 24 after the threads or yarns to be joined together have been inserted into it (in FIG. 4, the cover 27 not being shown, it having been removed from the head 23 to show the splicing chamber 24). Nozzles (not shown as they are well known) open into the splicing chamber 24 for feeding into it the compressed air jet used for making the pneumatic knotless joint.

On each side of the head 23 and spaced from it there are provided in succession: a preparation member, 28, 29 respectively, for pneumatically pretreating the thread or yarn ends to be joined together, a withdrawal lever, 30, 31 respectively, movable through a variable extent from its rest position (shown in FIG. 4) to withdraw the prepared thread or yarn ends in the direction of the splicing chamber 24, a clamping device 32, 33 respectively, with a fixed part 34, 35 respectively and a movable part 36, 37 respectively, for clamping the threads or yarns entering the splicing chamber 24, the lateral wall 21, 22 respectively also acting as the yarn guide plate, and a cutting device 38, 39 respectively for cutting the thread or yarn ends emerging from the opposing lateral openings 25, 26 respectively of the splicing chamber 24. The aforedescribed members and devices of the joining apparatus 14 are all known. The preparation members 28, 29 for pneumatically pretreating the thread or yarn ends to be joined together are shown only schematically on the figures, and by way of example can be of the type described in DE 38 04 684 or the corresponding U.S. Pat. No. 4,890,451, to which reference should be made for further constructional and operational details of these preparation members.

Figure 6:
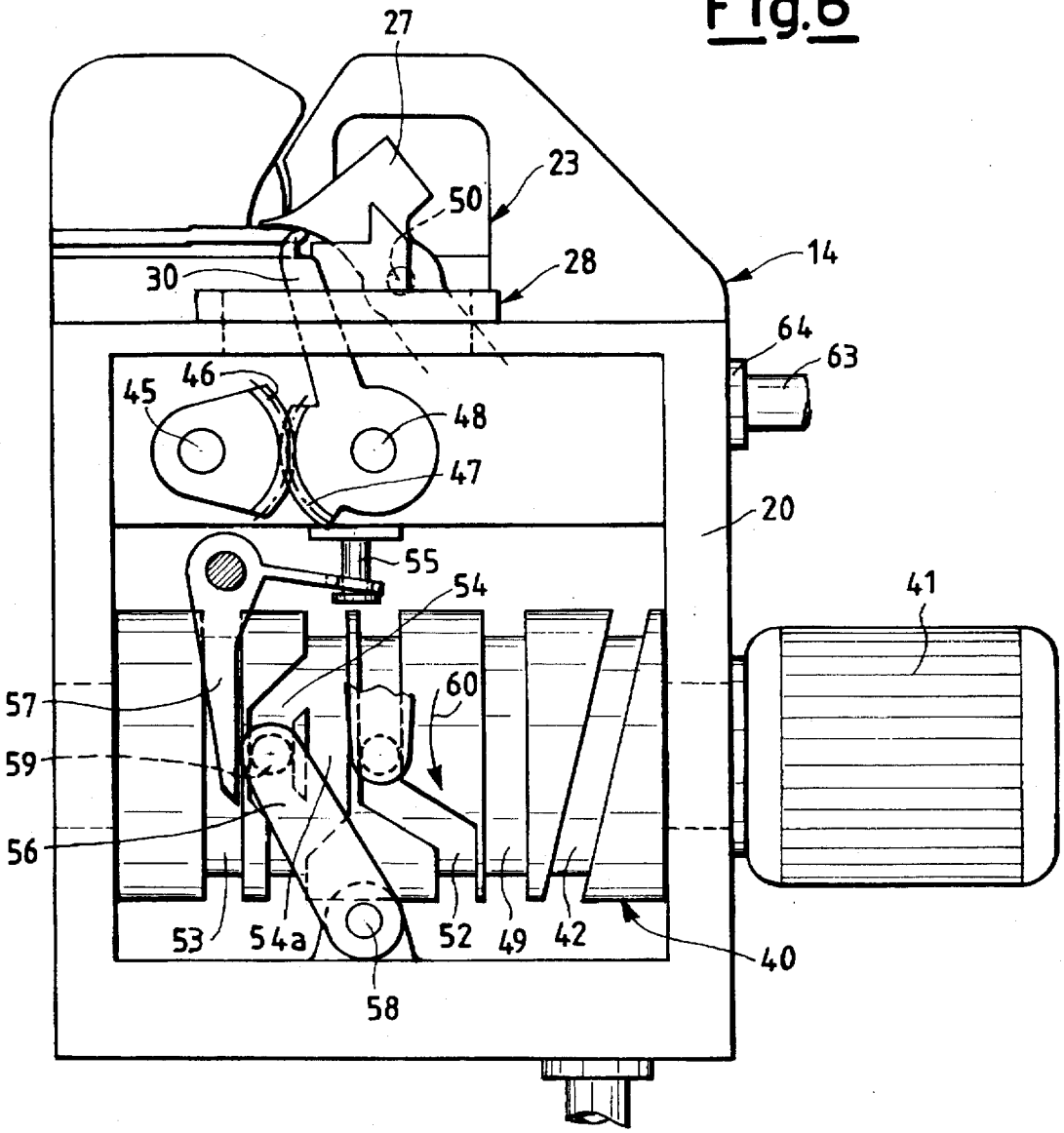
FIG. 6 is a side view of the joining apparatus of FIGS. 4 and 5 with certain parts removed.
Figure 7:
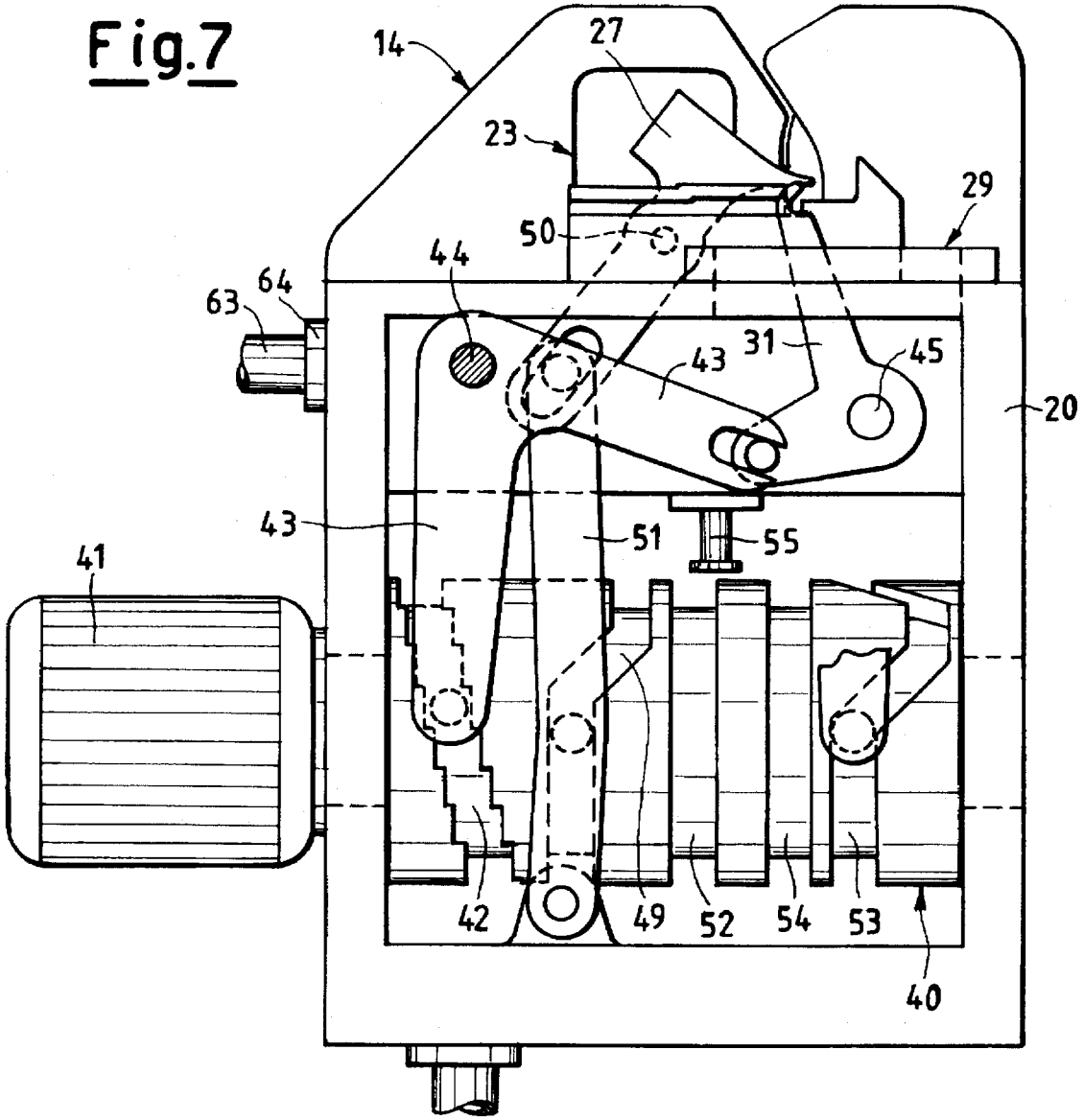
FIG. 7 is a side view of the joining apparatus taken from the opposite side to that of FIG. 6, with certain parts removed.

With reference to FIGS. 6 and 7, these show mounted rotatably within the hollow structure 20 of the apparatus a drum 40 which, according to the invention, can be rotated stepwise in an outward direction starting from a starting position and then be rotated in the opposite direction by a reversible electric stepping motor 41 fixed to the outside of the structure 20 of the apparatus 14. The motor 41 can be operated remotely by electrical pulses emitted by the computer-operated electronic control centre CE, as is shown schematically in FIG. 3.

On the periphery of the rotary drum 40 there is provided a series of cam tracks for controlling the movements of the movable parts of the joining apparatus 14. Specifically, a first profiled track 42 (to the left in FIG. 7) has on its side a progressively increasing contour, which is stepped in the illustrated embodiment and serves to move the withdrawal levers 30 and 31. In this respect, an angle lever 43, rotatable about a shaft 44, engages via a roller pin fixed to one of its ends the profiled track 42, and at its other end it acts on the withdrawal lever 31 pivoted at 45. On the opposite side of the structure 20, the pivot 45 of the withdrawal lever 31 carries a toothed sector 46 (see FIG. 6) which engages a further toothed sector 47, which is rigid with the opposite withdrawal lever 30 pivoted at 48. When the drum 40 is rotated in the outward direction, starting from a starting position under the stepwise control of the electric motor 41, the profiled track 42 causes the withdrawal levers 30, 31 to rotate progressively from their rest position (see FIG. 4) in the direction for withdrawing the thread or yarn parts, previously treated in the preparation members 28, 29, in the direction of the splicing chamber 24, with each point on the increasing contour of the track 42 there corresponding a determined angle of rotation of the levers 30, 31, this angle increasing progressively as the drum 40 rotates in the outward direction.

A second cam track 49 is used to control the closure and opening of the cover 27 about a pivot 50 by means of a lever 51 cooperating at one end with the contour of the track 49 via a roller pin, and at the other end with an arm rigid with the cover carrier (see FIG. 7).

A third and fourth cam track, 52, 53 respectively, are used to control the movements of the movable parts (or blades) of the cutting devices 38, 39 respectively, and of the movable parts 36, 37 of the clamping devices 32, 33, and finally a fifth cam track 54 provided on the periphery of the drum 40 between the third and fourth cam track 52, 53 respectively, is used in the illustrated embodiment to control a valve (of which only the operating stem 55 is shown in FIG. 7) for feeding a compressed air jet into the preparation members 28, 29 for the ends of the thread or yarn parts to be joined together. With regard to this latter cam track 54, it should be noted that in correspondence with its active portion by which it operates the valve (see FIG. 6) by way of levers 56, 57 it comprises an inactive bypass track **54*a* to prevent the valve from opening (by means of the stem 55) during rotation of the drum 40 in the return direction. As clearly shown in FIG. 6, the lever 56, pivoted at 58 and cooperating via a roller pin 59 with the cam track 54, is deviated and made to rotate about its pivot 58 (in the anticlockwise direction in FIG. 6) by the active portion of the cam track 54, so as to act on the angle lever 57 and hence operate the valve stem 55 (to lower it), only when the drum 40 rotates in the outward direction (indicated by the arrow 60 in FIG. 6), whereas when the drum 40 is rotated in the opposite return direction, the roller pin 59 of the lever 56 follows the inactive bypass track 54*a* with the result that the lever 56 is not deviated, hence preventing further operation (opening) of the valve by which the compressed air jet is fed into the preparation members 28, 29 when the drum 40, having been rotated stepwise from the starting position (indicated by 0° in the graphic representation of FIG. 8) in the outward direction (arrow 60 in FIG. 8**), is made to rotate stepwise in the opposite return direction to return to the starting position.

Figure 8:
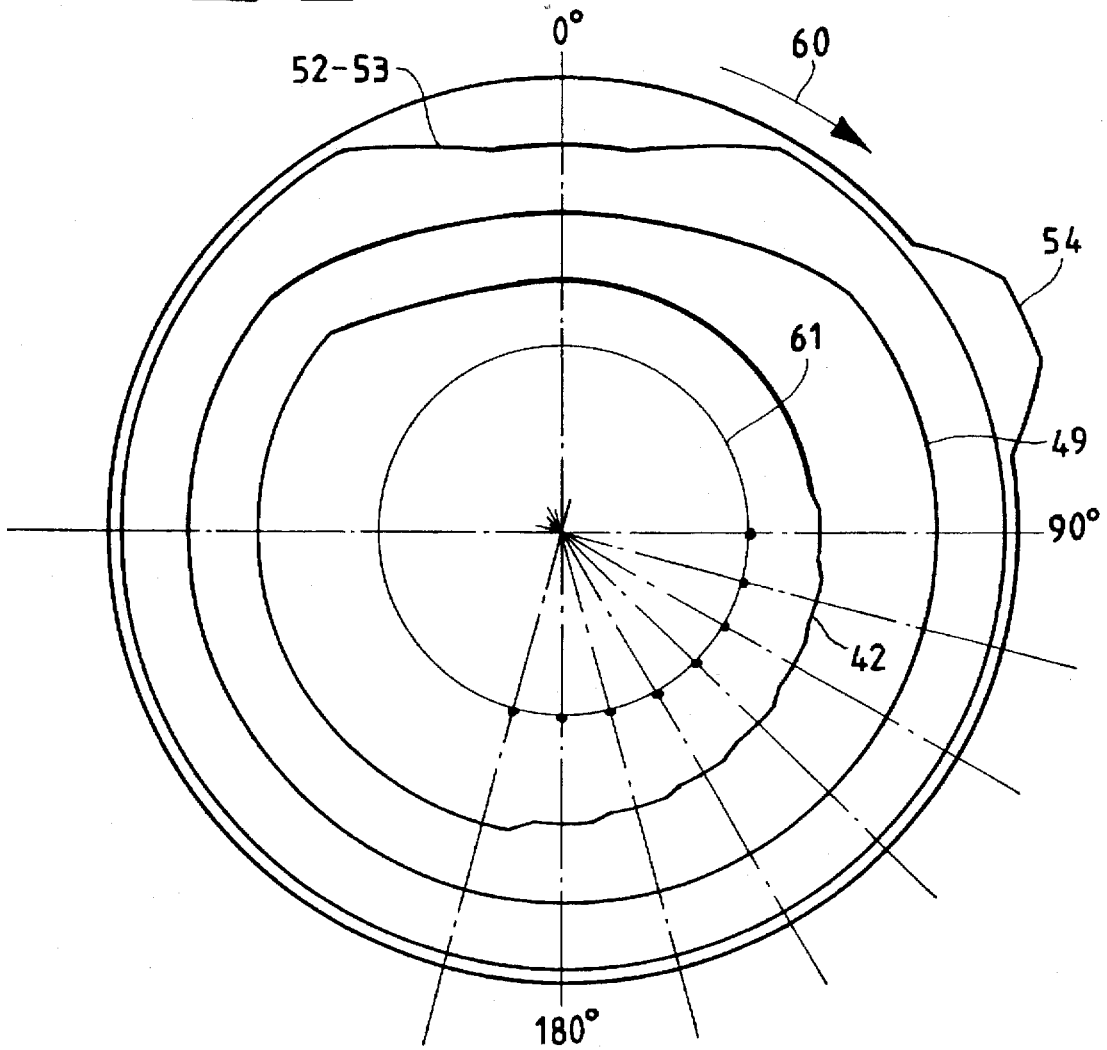
FIG. 8 is a graphic representation showing the tracks of the various controlling drum cams.

The graphic representation of FIG. 8 shows schematically the various cam tracks of the drum 40, and also indicates by means of the dots on an inner circle 61 the moment at which the valve has to be operated to feed the compressed air jet into the splicing chamber 24, on the basis of the variable displacement of the withdrawal levers 30, 31 from their rest position determined by the track 42 of increasing contour, in particular increasing stepwise.

To feed this compressed air jet into the splicing chamber 24, for each apparatus 14 there is provided in this embodiment an external solenoid valve 62 (shown in FIG. 3) controlled directly by the computer-operated electronic control centre CE, said solenoid valve when opened allowing compressed air to pass through a tube 63 connected to a connector 64 provided on the structure 20 of the joining apparatus/14. The connector 64 is connected via ducts 65 (shown schematically in FIG. 4), provided within the interior of the structure 20 and head 23, to the nozzles which open into the splicing chamber 24.

The described joining apparatus operates briefly as follows. When the sensing device 11 located in one of the winding positions of the machine indicates to the electronic control centre CE that there is an irregularity and/or interruption in the yarn being worked in that winding position, the control centre CE transmits control pulses or signals to halt the roller 13 in that winding position and then rotate it in the reverse direction, to cause the suction arms 15 and 16 to rotate so as to locate the yarns on the package and bobbin sides and insert them into the splicing chamber 24 of the respective joining apparatus 14, and then to cause the electric motor 41 of that particular joining apparatus to advance stepwise initially in the outward direction, to hence commence the pneumatic knotless yarn joining cycle by means of the joining apparatus 14 in question. The cover 27 of the joining apparatus 14 is closed by the action of the cam track 49, the clamping devices 32 and 33 are operated by the cam tracks 52 and 53 to clamp the yarns entering the splicing chamber 24, and the cutting devices 38 and 39 are operated by the same cam tracks 52 and 53 to cut the yarn ends emerging from the splicing chamber 24. The cut yarn ends are then inserted by suction into the preparation members 28, 29 for their pretreatment, the action of the cam track 54 opening via its stem 55 the valve for feeding the compressed air jet into these preparation members (see the stage shown in FIG. 4). As the stepwise rotation of the drum 40 proceeds in the outward direction, the cam track 42 acts to shift the withdrawal levers 30, 31 from their rest position to withdraw the pretreated yarn ends from the preparation members 28, 29 in the direction of the splicing chamber 24 (see stage shown in FIG. 5).

The parameters relative to the desired length by which the yarns are superposed on feeding the compressed air jet into the splicing chamber and to the moment and duration of the compressed air jet feed are previously set centrally in the electronic control centre on the basis of the type and characteristics of the yarn being worked in that winding machine section to which the winding position in which the pneumatic knotless yarn joint is to be made pertains. Specifically, the number of advancement steps set for the outward direction starting from the starting position of the electric motor 41, and hence for the drum 40 comprising the cam tracks, is such that in undergoing that number of steps in the outward direction the drum 40 brings into the working position that point on the contour of the cam track 42 which corresponds to the required rotation of the withdrawal levers 30 and 31 from their rest position to attain the desired length by which the prepared yarn ends are superposed. Hence after the set number of advancement steps in the outward direction, the electric motor 41 is automatically halted after which the pulses necessary to make it rotate in the reverse direction to reach the starting position are fed to it so as to also return the drum 40 with the cam tracks into its starting position and the various controlled movable members into their rest position.

The moment at which an electrical pulse is to be fed to the solenoid valve/62 to cause the compressed air jet to be fed into the splicing chamber 24 a determined time after the withdrawal levers 30 and 31 have halted in their required arrival positions (as indicated in the graphical representation of FIG. 8 on the circle 61) is set on the basis of the number of advancement steps which the electric motor 41 is made to undergo.

It will be apparent that if the duration of the compressed air jet to be fed into the members for preparing the yarn ends to be joined together is also to be adjusted, the valve by which the compressed air jet is fed into said preparation members must be operated separately instead of by the cam track 54 and the levers 56, 57 which cooperate with it. In this case a solenoid valve can be used in known manner, operated directly by signals originating from the electric computer-operated control centre CE. In this case, neither the cam track 54 nor the bypass track 54*a* is provided on the drum 40.

From the aforegoing description it is apparent that by virtue of the expedients provided according to the invention, it is possible to remotely regulate the length by which the prepared yarn ends are superposed on feeding the compressed air jet into the splicing chamber for making the pneumatic knotless joint. The other basic parameters (duration of the compressed air jets fed into the preparation members and into the splicing chamber) can instead be remotely regulated by the use of suitable solenoid valves operable separately from the outside and not by the controlling drum cams of the joining apparatus.

It has been stated that the cam 42 for controlling the movement of the withdrawal levers 30, 31 according to the invention must have in its active portion a progressively increasing contour so that as the number of advancement steps of the cam group in the outward direction increases from a starting position, for each successive point on the contour there is a progressively increasing displacement of the withdrawal levers 30, 31 from their rest position. Preferably, however, this contour is of stepped type so that for every angular position there is a more precise reference point in the movement of the controlled withdrawal levers 30, 31.

I claim:

1. A pneumatic thread or yarn knotless joining apparatus for installation on an automatic bobbin-winding machine, comprising:

a splicing chamber with two opposing lateral openings, and a longitudinal slot for inserting end portions of two threads or yarns to be joined;

a cover for temporarily closing the longitudinal slot in the splicing chamber;

means for pneumatically preparing the two thread or yarn portions to be joined together and positioned spaced from the opposing lateral openings of the splicing chamber;

means for feeding compressed air jets into the preparing means and into the splicing chamber;

means external to the splicing chamber for clamping adjacent said end portions, respective threads or yarns being inserted into said splicing chamber;

means for cutting thread or yarn ends of said end portions, where said ends emerge from the opposing lateral openings of the splicing chamber;

levers for withdrawing the thread or yarn ends from the preparing means towards the splicing chamber;

a group of drum cams for achieving and controlling synchronized movement of at least some of said cover, said clamping means, said cutting means, and said withdrawing levers, and a valve for feeding compressed air from an air jet into said preparing means;

a reversible electric stepping motor remotely operable by electrical pulses, to cause stepwise rotation of the group of controlling drum cams in an outward direction starting from a starting position and then, after a determined number of advancement steps, rotation in a return direction, said group of controlling cams comprising a cam of progressively increasing contour, for controlling the movement of said withdrawing levers such that as the advancement steps in the outward direction increase starting from the starting position of the group of drum cams, a progressively increasing movement of said withdrawing levers from a rest position of said withdrawing levers is induced for each successive point on said contour of said cam of progressively increasing contour; and valve being arranged to be operated by one of said group of controlling drum cams, by providing said one cam with an active track and with an inactive bypass track, so as to cause the valve to be open by said active track only during rotation of the group of drum cams in the outward direction and to prevent said valve from being opened during rotation of the group of drum cams in the return direction.

2. The joining apparatus of claim 1, wherein:

for feeding the compressed air jet into the splicing chamber there is provided a solenoid valve remotely controllable separately and independently by one said controlling drum cam immediately following the attainment of a desired movement of said withdrawing levers from said rest position thereof, upon termination of making of said advancement steps in said outward direction by said group of drum cams.

3. The joining apparatus of claim 1, wherein:

said progressively increasing contour has a stepped shape.

* * * * *